US005578097A

United States Patent [19]

Gaeta et al.

[11] Patent Number: 5,578,097

[45] Date of Patent: Nov. 26, 1996

[54] WASHABLE COATED ABRASIVES

[75] Inventors: Anthony C. Gaeta, Lockport; Gwo S. Swei, East Amherst, both of N.Y.

[73] Assignee: Norton Company, Worcester, Mass.

[21] Appl. No.: 520,216

[22] Filed: Aug. 28, 1995

[51] Int. Cl.[6] ..... B24D 3/34

[52] U.S. Cl. ..... 51/295; 51/298

[58] Field of Search ..... 51/293, 295, 298

[56] References Cited

U.S. PATENT DOCUMENTS 4,278,449 7/1981 Helletsberger et al. ..... 51/295

5,213,589 5/1993 Ronning et al. ..... 51/298

5,456,734 10/1995 Ryoke et al. ..... 51/295

*Primary Examiner*—Deborah Jones

*Attorney, Agent, or Firm*—David Bennett

[57] ABSTRACT

A washable coated abrasive material comprising a substrate and maker, size and optionally supersize coats and a functionalized polysiloxane modifying the binder of the outermost layer.

13 Claims, No Drawings

WASHABLE COATED ABRASIVES

BACKGROUND OF THE INVENTION

The present invention relates to the production of coated abrasives and particularly to the production of such materials that are washable, that is to say can be cleansed from swarf collected on the surface during grinding by simply hosing off the surface.

The problems associated with accumulated swarf have been appreciated for many years, particularly in the wood grinding field. This is because of the relative softness of wood which permits much longer active life for a coated abrasive item than might be the case when grinding metal. In addition the development of abrasive grains with improved performance has added to the problem of swarf accumulation.

It has been known that certain additives, when coated on the surface of a coated abrasive, tend to reduce the swarf accumulation. It has been suggested that various polysiloxanes, metallic stearates and waxes might be used and these are all somewhat effective. However, they function by imparting a hydrophobic character to a surface that is usually hydrophilic, and as grinding proceeds, this coating is relatively easily displaced from the surface and the effect is significantly reduced.

It has now been discovered that, if an appropriate additive is used, the persistence of the hydrophobic coating can be made to equal or exceed the useful life of the coated abrasive product.

GENERAL DESCRIPTION OF THE INVENTION

The present invention provides a coated abrasive comprising a substrate, a maker coat, a layer of abrasive particles adhered to the substrate by the maker coat, a size coat applied over the layer of abrasive particles and optionally a supersize coat appied over the size coat, wherein the last applied coat comprises a resin binder and a polysiloxane additive bonded to the resin binder.

Because there is a bond between the polysiloxane and the resin, the polysiloxane is not readily detached from the surface and remains effective even after prolonged grinding. The bond may be a chemical covalent bond or it may be hydrogen-bonding. Because for a typical coating there will be many such bonds between the coating and the binder, the effect is to immobilize the polysiloxane and prevent it from migrating or being wiped off during use.

The bond is formed by reaction of functional groups on the polysiloxane with functional groups on the binder. Thus the practice of the invention involves the careful selection and matching of the binder with the functional group on the polysiloxane. If for example the binder resin is a phenolic resin, an epoxy resin or a urea/formaldehyde resin, there will be large number of available hydroxyl groups. In this event the corresponding functional group in the polysiloxane could comprise for example a carboxylic acid, hydroxyl, amines, mercapto, epoxy or hydride functionality.

Where the resin comprises an unsaturated polyester or acrylate (co)polymer, (including acrylated and methacrylated resins), the preferred functional group on the polysiloxane could comprise a (meth)acrylate or vinyl group.

The functionalized polysiloxane can be incorporated in the size coat along with the resin to which it will be bonded. In this case the lower surface energy of the polysiloxane will ensure that the polysiloxane migrates to the surface layers where it will be most effective to supply the desired characteristics to the coated abrasive product.

Alternatively the functionalized polysiloxane may be applied in a suitable dispersing medium over the top of the top layer, which may be a size or supersize coat. Clearly the number of cooperating groups on the surface of the top layer will be greatest before the curing of the layer has been completed. It is therefore preferred that, if the functionalized polysiloxane is added over the top layer, this be done before cure of the layer is substantially completed. However, with most thermosets such as phenolics, the amount of residual reactive groups on the surface of the fully cured resin layer is often sufficient to ensure adequate bonding with the polysiloxane functional groups.

DETAILED DESCRIPTION OF THE INVENTION

Polysiloxane has a basic structure which is:

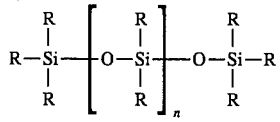

wherein each R is the same or different and is a hydrogen or a hydrocarbyl group such as methyl, ethyl, t-butyl, phenyl and the like and "n" is an integer that is at least 1. The most common polysiloxanes are those in which at least the majority of the R group are methyl or lower alkyl groups.

These may be homopolymers in which case the R groups are the same in each of the "n" repeated groups. This is not however to imply that within the repeating groups and in the terminal groups, the groups represented by "R" must always be the same.

Alternatively the polysiloxanes can be formed by copolymerization in which the formula would be:

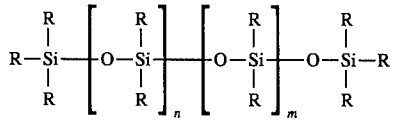

wherein n and m are the same or different integers and the "n" repeating groups are different in terms of the R groups present from the "m" repeating groups.

A further alternative structure is the so-called "T" structure:

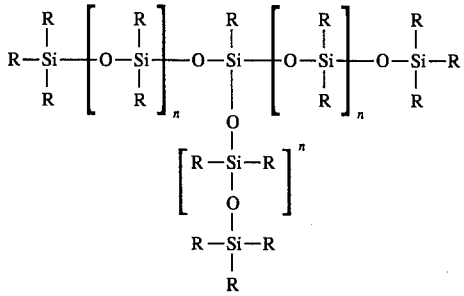

wherein each n is the same or different and is an integer that is at least 1.

In the functionalized polysiloxanes useful in the present invention at least one of the groups R in the formulations set forth above is replaced by a functional group that is capable of reacting with a group in the resin structure. Since the presence of a plurality of such groups would increase the opportunities to form such bonds, it is preferred that several such groups be functionalized. In particular copolymer structures are preferred in which each repeating unit of at least of the comonomers comprises at least one functionalized group.

Typical useful functional groups include amino; methacrylate and acrylate; mercapto; carboxylic acid; vinyl; epoxy; and hydride.

While the nature of the reactive functionality is determined by the co-reactive functionalities in the resin, these may be connected to the siloxane polymer backbone by any convenient linking group. For example in a commercial functionalized polysiloxane, sold by BYK Chemie U.S.A. under the trade name BYK-370, the polysiloxane is a copolymer with the formula:

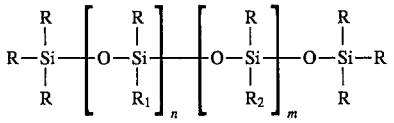

wherein $R_2$ is a $C_pH_{2p+1}$— group where "p" is from 5 to 8; $R_1$ is a polyester group with a terminal hydroxyl group having the formula:

$$—CH_2—[O—CO.R_3.CO—O—R_3]_q—OH$$

wherein $R_3$ is a lower alkyl group and q is an integer from 1 to 8; and all other groups "R" are methyl groups. This polysiloxane is found to be particularly effective in forming bonds with phenolic resins. Other reactive polysiloxanes are available commercially including the Huls products identified as PS-510; PS-805; and PS-820.

The introduction of the functionalized groups can also be brought about by appropriate choice of siloxanes or chain terminating agents which can themselves contain the desired functionalizing group or alternatively another group readily convertible to the desired group without adversely affecting the polysiloxane properties.

The choice of the values of "n" and/or "m" in preferred polysiloxanes leads to a product with a viscosity of from about 20,000 to about 25,000 centipoises.

The amount of the polysiloxane that can be used is typically from about 0.5 to about 20% and more preferably from about 1 to about 10%, and still more preferably from about 2 to about 5% of the weight of the resin in the layer to which the polysiloxane is bonded. Where the polysiloxane is added to the formulation of the top layer, then the amount of polysiloxane added to the formulation is calculated on the basis of solids weight of the resin in the formulation.

DESCRIPTION OF PREFERRED EMBODIMENTS

The invention is now further described with reference to the following Examples which are for the purpose of illustation only and are intended to imply no necessary limitation on the scope of the invention.

Example 1

A polycotton cloth substrate material was coated with 6.5 pounds/ream, (91.9 g/m$^2$), of 180 grit fused aluminum oxide abrasive grits using a conventional phenolic maker coat formulation. This was then treated phenolic maker coat formulation. This was then treated with a conventional phenolic size coat to which had been added a functionalized polysiloxane, (BYK-370), and the cure of the size coat was completed.

Several sheets were prepared with different amounts of BYK-370. These sheets were then cut into discs which were evaluated in a Schieffer testing procedure on maple wood to determine their washability after grinding. Grinding was continued until the surface was judged to be filled with wood grinding debris. The results appear in the Table below.

TABLE

| % BYK IN SIZE | HYDROPHOBIC PRE-GRIND | HYDROPHOBIC POST-GRIND | WASHABILITY POST-GRIND |
|---|---|---|---|
| None | NO | NO | FAIR |
| 0.5 | YES | NO | GOOD |
| 1.0 | YES | YES | VERY GOOD |
| 2.0 | YES | YES | VERY GOOD |
| 4.0 | YES | YES | EXCELLENT |

The above clearly indicates that the polysiloxane had migrated to the surface of the size coat remained there even after grinding. The hydrophobicity of the surface was judged by pouring water on to the disc and determining whether the water beaded up or wetted the surface. Even though, at 0.5% polysiloxane the surface was not judged hydrophobic, nevertheless the surface could readily be washed clear of wood grinding residue. Above that level the surface was not wetted by the water and the debris was easily removed.

The same discs were subjected to a simple test to reveal the surface energy of the modified surface. Each was sprayed using a can of spray paint. The paint adhered to some extent to the unmodified surface but was very easily removed from the treated surfaces. This showed the low surface energy and oleophobic character of the modified surfaces.

What is claimed is:

1. A coated abrasive comprising a substrate, a maker coat, a layer of abrasive particles adhered to the substrate by the maker coat, a size coat applied over the layer of abrasive particles and optionally a supersize coat appied over the size coat, wherein the coat applied last comprises a resin binder and a polysiloxane additive bonded to the resin binder.

2. A coated abrasive according to claim 1 in which the polysiloxane additive is functionalized to provide a plurality of functional groups that form bonds with groups on the resin binder.

3. A coated abrasive according to claim 1 in which the resin binder is selected from the group consisting of phenolic, urea-formaldehyde, epoxy resins, acrylated and methacrylated resins and unsaturated polyester resins and mixtures thereof.

4. A coated abrasive according to claim 1 in which the resin binder has a plurality of hydroxyl groups and the polysiloxane has a plurality of functional groups that react with the hydroxyl groups on the resin binder.

5. A coated abrasive according to claim 1 wherein the polysiloxane additive is present in a proportion, based on the weight of the resin binder, of from about 0.5 to about 20% by weight.

6. A coated abrasive according to claim 5 in which the proportion of the polysiloxane is from about 2 to about 10 by weight.

7. A coated abrasive according to claim 1 in which the resin binder in the last applied coat comprises hydroxyl functional groups and the polysiloxane comprises are hydroxy-terminated polyester groups that are reactive with said hydroxyl groups.

8. A process for the production of a coated abrasive said process comprising:

a) providing a substrate having abrasive grits adhered thereto by a maker coat;

b) applying over said abrasive grits a size coat comprising a resin binder;

c) optionally applying a supersize coat that also comprises a resin binder; and d) modifying the surface of the coat applied last with a polysiloxane having functional groups that bond with functional groups present in the resin binder in that coat.

9. A process according to claim 8 in which the polysiloxane is added in admixture with the resin binder in the last-applied coat.

10. A process according to claim 8 in which the binder resin in the last applied coat is selected from the group consisting of phenolic, urea-formaldehyde, epoxy resins, acrylated and methacrylated resins and unsaturated polyester resins and mixtures thereof.

11. A process according to claim 10 in which the binder resin in the last applied coat is a phenolic resin.

12. A process according to claim 8 in which the polysiloxane is present in an amount that is from about 0.5 to about 20% of the binder resin weight.

13. A process according to claim 12 in which the polysiloxane is present in an amount that is from about 2 to about 10% of the binder resin weight.

* * * * *